United States Patent [19]

Kishikawa et al.

[11] Patent Number: 4,503,699

[45] Date of Patent: Mar. 12, 1985

[54] METHOD AND APPARATUS FOR ROLLING RAILS

[75] Inventors: Kanichi Kishikawa; Taneharu Nishino; Seiichi Nagasoe, all of Kitakyushu, Japan

[73] Assignee: Nippon Steel Corporation, Tokyo, Japan

[21] Appl. No.: 509,014

[22] Filed: Jun. 27, 1983

[30] Foreign Application Priority Data

Jun. 30, 1982 [JP] Japan ..... 57-111451

[51] Int. Cl.[3] ..... B21B 1/08

[52] U.S. Cl. ..... 72/222; 72/225; 72/234; 72/366

[58] Field of Search ..... 72/225, 226, 229, 221, 72/222, 228, 234, 366

[56] References Cited

U.S. PATENT DOCUMENTS

| | | | |
|---|---|---|---|
| 3,657,912 | 4/1972 | Ishibashi et al. | 72/234 |
| 4,393,680 | 7/1983 | Kovacs | 72/221 X |
| 4,400,962 | 8/1983 | Michaux | 72/225 X |

FOREIGN PATENT DOCUMENTS

| | | |
|---|---|---|
| 46-17575 | 5/1971 | Japan . |
| 46-17576 | 5/1971 | Japan . |

*Primary Examiner*—Leon Gilden
*Assistant Examiner*—Steven B. Katz
*Attorney, Agent, or Firm*—Wenderoth, Lind & Ponack

[57] ABSTRACT

The rail is rolled by the steps of breakdown rolling, reforming rolling, first and second universal rolling, head-wheel rolling and base-wheel rolling in that order. The reforming rolling is performed using a pair of horizontal rolls provided with a reforming pass and a head-wheel pass and a vertical roll adapted to reduce the base of the rail, with the paired horizontal rolls, together with said vertical roll, shifted and set in such a position where the reforming pass matches the pass line of the first universal rolling pass. The head-wheel rolling is performed using the same paired horizontal rolls and a vertical roll adapted to reduce the head of the rail, with the paired horizontal rolls, together with said vertical roll, shifted and set in such a position where the head-wheel pass matches the pass line of the second universal rolling pass. The rail rolling apparatus comprises a breakdown stand, a sizing head-wheel stand having a pair of horizontal rolls provided with a reforming pass and a head-wheel pass, a vertical roll adapted to reduce the base of the rail, a vertical roll adapted to reduce the head of the rail, and mechanism for shifting the rolls, a universal stand, and a base-wheel rolling stand.

2 Claims, 7 Drawing Figures

METHOD AND APPARATUS FOR ROLLING RAILS

BACKGROUND OF THE INVENTION

This invention relates to a method and apparatus for rolling rails.

In deciding the number and layout of stands for rolling shapes in general, the most economical layout is chosen with the intended product mix, quantity of production and quality control requirements in view. In order to obtain the mechanical properties desired in rails, the rolling apparatus and method must be capable of providing a total elongation (the ratio between the cross-sectional areas of the bloom and product rail) of not lower than 8.0 using continuously cast blooms for rails as specified by the British Standards.

FIG. 1 shows the layout of a typical universal rail rolling mill. At this mill, a bloom BL is rolled into a product rail by a breakdown stand BD, a roughing stand R, a first universal stand $U_1$, an edger stand E, a second universal stand $U_2$, a head-wheel stand H, and a base-wheel stand B in that order. FIG. 2 shows the rolls and pass contours of the individual stands. The piece passes over the breakdown stand BD seven times, the rolls thereon forming six passes 1 through 6. The piece passes over the roughing stand R three times, the rolls thereon forming three passes 7 through 9. The last pass 9 in the roughing stand R is vertically symmetrical with respect to the horizontal center line and called the "reforming pass." The shape of the finished rail is symmetrical with respect to the center line of the web. As shown in FIG. 2, all passes formed by the first universal stand $U_1$ through the base-wheel stand B are symmetrical with respect to the center line of the web. For this reason, it is essential to pass the rail through the reforming pass 9 immediately before rolling in the first universal stand $U_1$ is implemented.

Reversed rolling is effected three times continuously between the first universal stand $U_1$ and the edger stand E. Two passes 11 and 12 are formed by the rolls of the edger stand E. The rolling operation between the first universal stand $U_1$ and the edge stand E is carried out by passing the piece through the passes in the following order; 10-11-11-10-10-12. The cross-section of the piece grows smaller each time it passes through the pass 10 on the universal stand $U_1$ since both horizontal and vertical rolls thereon are brought closer for every succeeding passage. The shape of the pass 11 conforms to the cross section of the piece that is attained after the first passage through the pass 10 on the universal stand $U_1$, while the shape of the pass 12 conforms to the cross section of the piece that is attained after the third passage therethrough. The edger stand E has a quick pass replacer QS that brings the pass 11 or 12 into rolling position in conformity with the number of the rolling being conducted in the preceding universal stand $U_1$.

One continuous rolling operation is implemented between the second universal stand $U_2$ and the head-wheel stand H. The second universal stand $U_2$ has a head-side vertical roll 13 which is kept in contact with the side MT of horizontal rolls 14. This arrangement is essential for defining the thickness and height of the rail head. On the head-wheel stand H where pre-finishing rolling is conducted, fine adjustment of the head thickness and base width is achieved by adjusting the position of a head-side vertical roll 15 and horizontal rolls 16. On the base-wheel stand B where finishing rolling is conducted, fine adjustment of the head width, web thickness and base thickness is achieved by adjusting the position of a base-side vertical roll 17 and horizontal rolls 18.

As might be understood from the above description, the universal rail rolling method and apparatus must fulfill the following requirements:

(1) The reforming pass is provided immediately ahead of the universal rolling stand.

(2) The final universal rolling is carried out with the head-side vertical roll kept in contact with the side of the horizontal rolls.

(3) The product rail is finished by applying the universal, head-wheel and base-wheel rolling in that order.

Generally, the ratio between the cross-sectional areas which the piece possesses before and after passing through a single pass is known as "elongation." Table 1 lists approximate values of elongation resulting from the passes peculiar to the universal rolling of rails.

TABLE 1

| Rolling Stand | R (Pass 9) | $U_1$ | E | $U_2$ (MT) | H | B |
|---|---|---|---|---|---|---|
| Elongation | 1.08 | 1.25 | 1.02 | 1.15 | 1.03 | 1.07 |

FIGS. 3 and 4 show conventional universal rail rolling mills that are simpler than the one shown in FIG. 1. The mill in FIG. 3 dispenses with the roughing stand R shown in FIG. 1, whereas that in FIG. 4 dispenses with the second universal stand $U_2$ and head-wheel stand H. With respect to the mill of FIG. 4, it may be said that combining the edger stand E and head-wheel stand H into a rolling stand EH has permitted integrating the universal stands $U_1$ and $U_2$ into one universal stand.

The number of passes in the mill shown in FIG. 4 is fewer than that in the mill of FIG. 1 because one pass through each of the second universal stand $U_2$ and edger stand E are omitted. However, two additional passes are carried out in the breakdown stand BD in order to obtain a greater total elongation. Nevertheless, the number of passes and stands as a whole is not sufficient.

In the mill of FIG. 3, omission of three passes in the roughing stand R is made up for by providing the greatest elongation among the three mills being discussed in the breakdown stand BD. Despite this, however, total elongation is only slightly greater than 8.0. Owing to this insufficient elongation, the mill shown in FIG. 3 does not use a reforming pass.

Because of the poor reforming function, these conventional rolling methods and apparatuses have been unable to roll rails with a high degree of dimensional and shape accuracy without employing a large number of passes.

SUMMARY OF THE INVENTION

The object of this invention is to provide a method and apparatus for rolling rails that permit reducing the number of rolling passes and stands while maintaining the required total elongation.

The rail rolling method according to this invention comprises the steps of breakdown, reforming rolling, first universal rolling, second universal rolling, head-wheel rolling and base-wheel rolling.

The reforming rolling is carried out using a pair of horizontal rolls provided with a reforming pass and a head-wheel pass and a vertical roll adapted to reduce the thickness of and shape the base of the rail, with the paired horizontal rolls, together with said vertical roll, shifted and set so that the reforming pass thereon matches the pass line of the first universal rolling. The head-wheel rolling is effected using the same paired horizontal rolls and a vertical roll adapted to reduce the thickness of and shape the head of the rail, with the paired horizontal rolls, together with said vertical roll, shifted and set so that the reforming pass thereon matches the pass line of the second universal rolling.

The rail rolling apparatus according to this invention comprises: a breakdown stand; a rolling stand having a pair of horizontal rolls provided with a reforming pass and a head-wheel pass, a vertical roll adapted to reduce the thickness of the base of the rail, a vertical roll adapted to reduce the thickness of the head of the rail, and a mechanism to shift the position of said rolls; a universal stand; and a base-wheel stand.

The rolling method of this invention dispenses with the reforming pass in the breakdown process that provides only light reduction by bringing the piece rough rolled on the breakdown stand directly into the universal stand while retaining the reforming function to ensure that the head and base of rails are symmetrically shaped. At the same time, it increases the amount of elongation per pass and thereby permits reducing the number of passes and stands by combining the reforming function with the reducing function through the implementation of universal rolling in the reforming stand.

As might be understood from the above, this invention provides a universal rail rolling method that can be implemented with the smallest number of passes ever employed. The rail rolling according to this invention is accomplished with the use of a breakdown stand, a universal stand, a sizing head-wheel stand, and a base-wheel stand. Besides, a breakdown stand of the conventional type is well suited for use in the invention. All this leads to the most economical universal rail rolling mill thus far developed and which takes up a minimum of space.

DETAILED DESCRIPTION OF THE PREFERRED EMBODIMENTS

Figure 1:
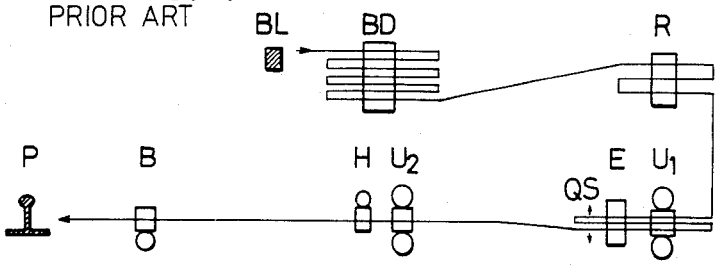
FIG. 1 PRIOR ART
FIG. 1 shows the arrangement of a typical mill for implementing a universal rail rolling method of the conventional type.
Figure 2:
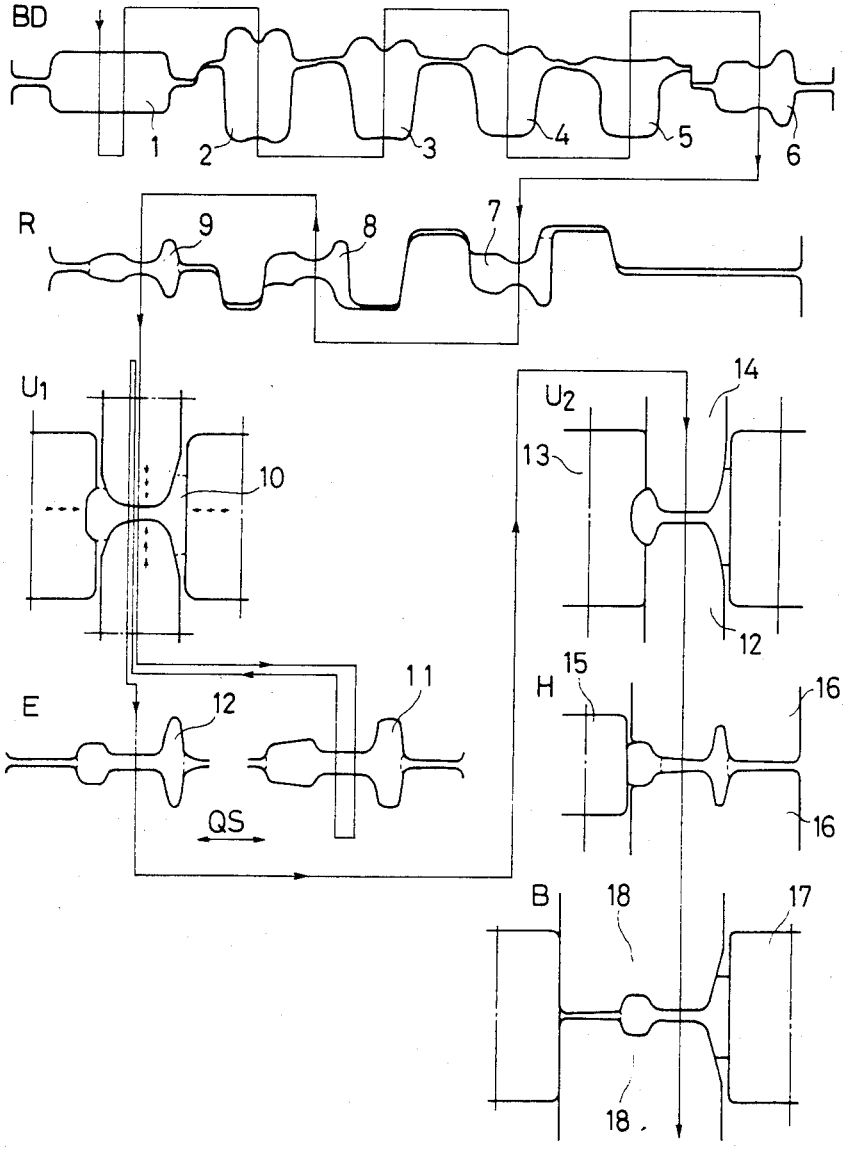
FIG. 2 PRIOR ART
FIG. 2 shows the contours of the rolls and rolling passes in the individual stands shown in FIG. 1.
Figure 3:
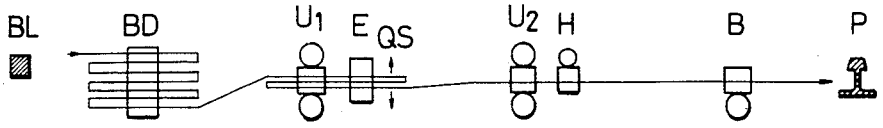
FIG. 3 PRIOR ART
FIGS. 3 and 4 show the arrangement of mills for implementing other universal rail rolling methods of the conventional type.
Figure 4:
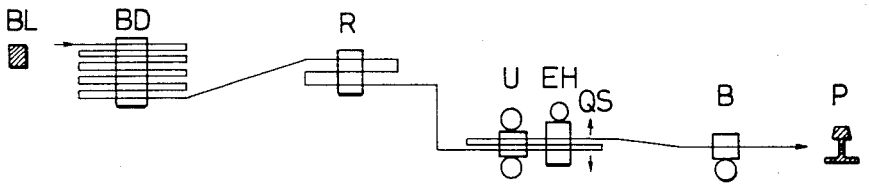
FIG. 4 PRIOR ART
Figure 5:
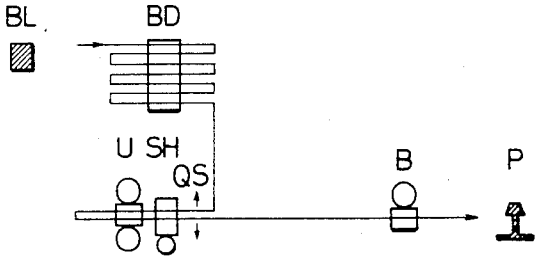
FIG. 5 shows the arrangement of a rolling mill embodying the principle of this invention.

Now this invention will be described in detail with reference to FIGS. 5 through 7.

The rolling method of this invention uses a sizing head-wheel stand SH that serves the dual function of reforming rolling and head-wheel rolling. As illustrated in FIG. 5, the bloom BL is rolled to the product rail P by being passed through a breakdown stand BD, one side of a sizing head-wheel stand SH, twice through a universal stand U, the other side of the sizing head-wheel SH, and a base-wheel stand B in that order.

Figure 6:
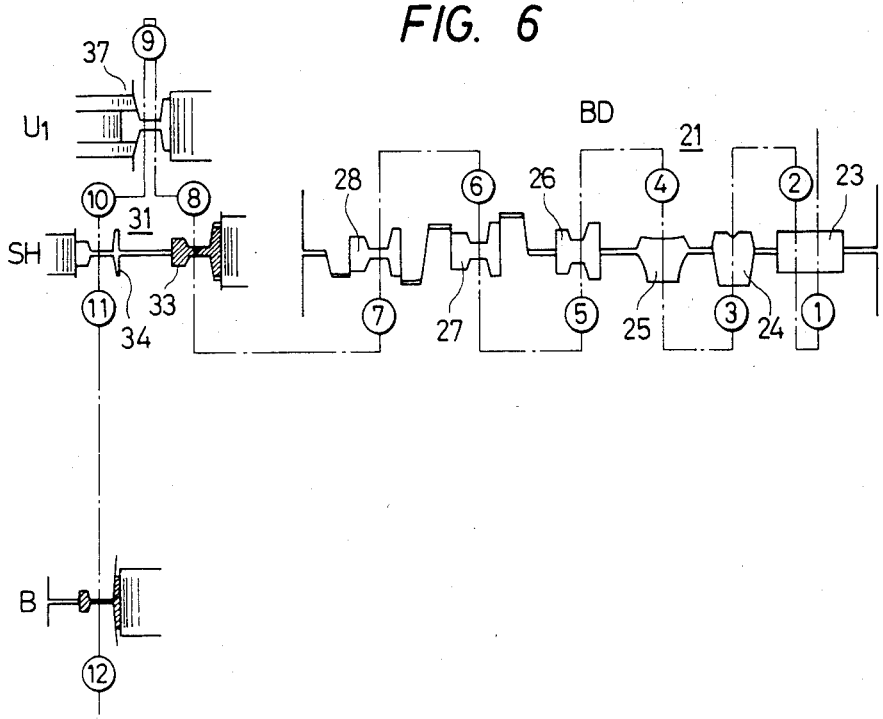
FIG. 6 shows the contours of the rolls and rolling passes in the individual stands shown in FIG. 5.

FIG. 6 shows the contours of the rolls and rolling passes in the individual stands of the mill being discussed.

Six passes 23 through 28 are turned in breakdown rolls 21 through which the piece is passed seven times as indicated by circled numbers 1 through 7. No reforming pass is provided in the breakdown rolls. Provision of a reforming pass, although the amount of reduction and work performed thereby is small, calls for a longer roll body. If the length of the large-diameter rolls on the breakdown stand BD which is powered by a large-capacity motor were increased, the following disadvantages would result:

(a) The unit weight of the rolls increases which causes an increase in the energy consumption rate thereof.

(b) The increase in the roll body length leads to an increase in the stand size.

(c) The strength of the rolls drops.

(d) The ratio of reaction on the screws on the drive and work sides as well as the reaction on one side increases, which, in turn necessitates an increase in the size of the screwdown mechanism and other parts of the stand.

A reforming pass 33 and a head-wheel pass 34 are provided in the horizontal rolls 31 in the sizing head-wheel stand SH. Continuous reversed rolling is effected twice, as indicated by circled numbers 8 through 11, between the sizing head-wheel stand SH and the universal stand U. The piece travels through the passes in the following order; 33-37-37-34. This permits rolling rails with exact dimensional accuracy and reducing the size of the mill building.

This invention has three technical features. The first one is the new proposal for the rolls 31 on the sizing head-wheel stand SH. The second one is the double continuous reversed rolling between the rolls 31 on the sizing head-wheel stand SH and the rolls 37 on the universal stand U. This permits ideal rolling which comprises final breakdown rolling in the breakdown stand, reforming rolling in a reforming pass in a sizing head-wheel stand, first universal rolling, second universal rolling, head-wheel rolling in a head-wheel pass in the sizing head-wheel stand, and base-wheel rolling in the base-wheel stand as indicated by the circled number 12. The third one is the elimination of edger rolling that achieves only a limited amount of elongation. For the second pass on the universal stand, the vertical roll is brought into contact with the side of the horizontal rolls as is done conventionally. Base-wheel rolling also is effected in the conventional manner.

This invention makes it possible to perform universal rail rolling in only four rolling stands. The following paragraphs discusses the total elongation achieved by the rolling method of this invention.

The number of passes employed by the method of this invention is fewer than that of the conventional methods because the passes can be designed so that the amount of elongation per pass is larger. Table 2 shows the amount of elongation per pass achieved between the reforming rolling and the pass-wheel rolling according to this invention. Based on the maximum values of actual elongation achieved at each pass of the conventional method, the values shown are enough for assuring the production of good-quality rails.

TABLE 2

| Rolling Stand | SH (Pass 33) | U | U (MT) | SH (Pass 34) | B |
|---|---|---|---|---|---|
| Elongation | 1.10 | 1.33 | 1.21 | 1.03 | 1.09 |

As shown in FIG. 6, six passes are provided in the break-down rolls 21; one box-shaped pass 23, two hat-like passes 24 and 25, one open pass 26, and two closed passes 27 and 28. With the box-shaped pass 23 being that which is essential for allowing the passage of the continuously cast bloom for rails, rail forming is accomplished in the remaining five passes.

The piece travels through the six passes including the box-shaped pass seven times when rolling light-gage rails and nine times when rolling heavy-gage rails.

According to Table 2, The cumulative elongation achieved from the reforming rolling through the base-wheel rolling is $1.10\times1.33\times1.21\times1.03\times1.09=1.99$. With the total elongation for rail rolling being specified as not lower than 8.0, the cumulative elongation which must be achieved in the seven breakdown passes is $8.0\div1.99=4.02$. Accordingly, the mean elongation for each of the seven breakdown passes is $4.02=1.22$. This indicates that the method according to this invention is close to the critical limit of the universal rail rolling technique.

Figure 7:
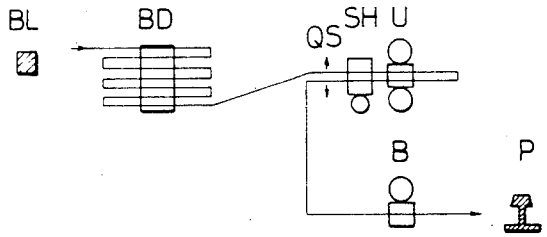
FIG. 7 shows the arrangement of another rolling mill embodying the principle of this invention.

FIG. 7 shows the layout of another rolling mill according to this invention, which is different from the one shown in FIG. 6 only in that the sizing head-wheel stand SH and the universal stand U are placed in different positions.

What is claimed is:

1. A method of rolling rails, comprising the steps of:

performing breakdown rolling to produce a rough rolled rail;

then performing reforming rolling on the rough rolled rail in a reforming pass in a pair of horizontal rolls having a reforming pass and a head-wheel pass and a first vertical roll cooperating with the reforming pass to reduce the base of the rail therein and a second vertical roll cooperating with said head-wheel pass to reduce the head of the rail therein;

passing the rail from the reforming pass along the pass line of the reforming pass and performing a first universal rolling of the rail and performing a second universal rolling thereof;

while universal rolling is being performed, shifting the horizontal rolls and said vertical rolls to match the head-wheel pass with the pass line of the second universal rolling;

performing the head-wheel rolling using said horizontal rolls and the second vertical roll for reducing the head of the rail; and performing base-wheel rolling on the rail rolled in said head-wheel pass for finishing the rail.

2. The method according to claim 1 in which the reforming rolling, the first and second universal rolling and the head-wheel rolling and passing the rail along the pass line of the reforming pass are performed by passing the rail from the stand having said paired horizontal rolls to a universal stand and passing the rail through the universal stand in the reverse direction and then through said head-wheel pass.

* * * * *